US007550926B2

(12) United States Patent
Chai et al.

(10) Patent No.: US 7,550,926 B2
(45) Date of Patent: Jun. 23, 2009

(54) HIGHSTRENGTH DISCHARGE LAMP WITH LOW GLARE AND HIGH EFFICIENCY FOR VEHICLES

(76) Inventors: Guosheng Chai, A Zone, Shi-Shan Technology Industry District, Nanhai, Fushan, Guongdong Province 528 225 (CN); Zhengming Yang, A Zone, Shi-Shan Technology Industry District, Nanhai, Fushan, Guongdong Province 528 225 (CN); Guangyi Gao, A Zone, Shi-Shan Technology Industry District, Nanhai, Fushan, Guongdong Province 528 225 (CN); Ming Zhang, A Zone, Shi-Shan Technology Industry District, Nanhai, Fushan, Guongdong Province 528 225 (CN)

( * ) Notice: Subject to any disclaimer, the term of this patent is extended or adjusted under 35 U.S.C. 154(b) by 327 days.

(21) Appl. No.: 10/560,562

(22) PCT Filed: Apr. 29, 2004

(86) PCT No.: PCT/CN2004/000429

§ 371 (c)(1),
(2), (4) Date: Dec. 12, 2005

(87) PCT Pub. No.: WO2005/045880

PCT Pub. Date: May 19, 2005

(65) Prior Publication Data

US 2007/0018549 A1 Jan. 25, 2007

(30) Foreign Application Priority Data

Nov. 6, 2003 (CN) ..... 2003 2 0117732
Nov. 6, 2003 (CN) ..... 2003 2 0117733
Dec. 24, 2003 (CN) ..... 2003 2 0119661

(51) Int. Cl.
*H01J 1/02* (2006.01)
*H01J 17/16* (2006.01)

(52) U.S. Cl. ..... 313/639; 313/318.01; 313/634

(58) Field of Classification Search ..... 313/639, 313/634, 635, 623, 626, 318.01, 318.08, 313/318.09

See application file for complete search history.

(56) References Cited

U.S. PATENT DOCUMENTS 4,879,491 A * 11/1989 Hirozumi et al. ..... 313/318.1
5,497,049 A * 3/1996 Fischer ..... 313/634
5,610,469 A * 3/1997 Bergman et al. ..... 313/25
5,646,471 A * 7/1997 Scholler et al. ..... 313/25
5,736,811 A * 4/1998 Westemeyer et al. ... 313/318.02

* cited by examiner

*Primary Examiner*—Bao Q Truong
(74) *Attorney, Agent, or Firm*—Charles E. Baxley

(57) ABSTRACT

A high intensity discharge lamp has an arc tube, which is filled with substances for gas discharge. The arc tube includes a bulbous portion. Surrounding the arc tube there is a tubular envelope. The envelope has an enlarged portion, which is similar to the bulbous portion. The distance between the envelope and the outer wall of the arc tube is uniform thereby resulting in uniform temperature distribution on the wall of the arc tube, improved thermal stability, improved luminous and electrical parameters. The lamp reduces the light refraction which occurs between the inner surface of the envelope and the outer surface of the arc tube and also between the two interface of the envelope wall thereby emitting more light and reducing the occurrence of glare.

4 Claims, 3 Drawing Sheets

HIGHSTRENGTH DISCHARGE LAMP WITH LOW GLARE AND HIGH EFFICIENCY FOR VEHICLES

FIELD OF THE INVENTION

The present invention relates generally to the field of lamps and more particularly to a high intensity discharge lamp with low glare and high efficiency for automobiles.

BACKGROUND OF THE INVENTION

Conventional low power xenon metal halide discharge lamps such as the capped lamp known from U.S. Pat. No. 5,736,881A, U.S. Pat. No. 5,646,471A have been widely used as head lights for vehicles in Japan and Europe.

These kinds of lamps when installed in vehicle lanterns always emit substantially more glare than halogen tungsten lamps. As a result special lanterns, reflectors, lenses, lens hoods and light shields must be provided to limit the glare and to form the desired light beam profile in order to meet applicable vehicle lamp regulations. This results in relatively high cost.

OBJECTS AND SUMMARY OF THE INVENTION

It an object of the present invention to transform glare into a useful light beam and to increase the efficiency of the lamp.

Another object of the present invention is to provide a capped xenon metal halide lamp for vehicles with higher light beam efficiency, less glare, more uniform wall temperature distribution on the arc tube, more stable luminous and electrical parameters at a lower cost as compared with conventional lamps.

Other objects and advantages of the invention will be made clear hereinafter.

In accordance with the present invention there is provided a capped xenon metal halide discharge lamp for vehicles which includes an arc tube with two neck shaped portions. The arc tube and the two neck shaped portions are surrounded by an outer gas tight tubular envelope having a ball shaped portion, which surrounds the ball shaped arc tube. The first end of the envelope is mounted on a cap. An end of the neck shaped portion of arc tube is expanded to form a bell shape. The edge of the bell nearly touches the outer envelope and the arc tube and the envelope are flame sealed to form a gas tight seal.

BRIEF DESCRIPTION OF THE DRAWINGS

Other objects and advantages of the present invention will become apparent from the following description taken in connection with the following drawings in which.

DETAILED DESCRIPTION OF THE INVENTION

Figure 1:
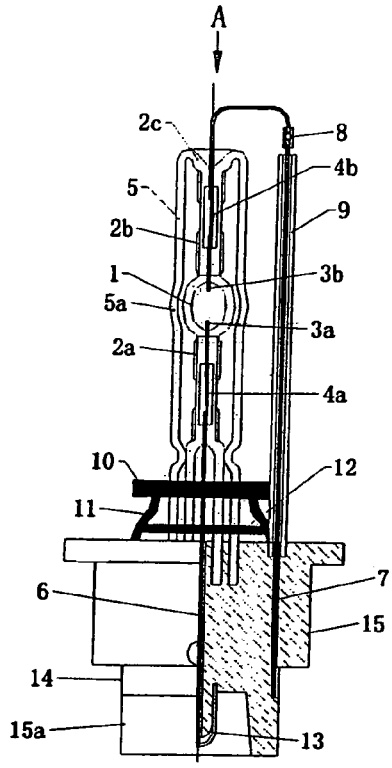
FIG. 1 shows the primary embodiment of the invention in side elevation, with portions shown partly broken away.
Figure 2:
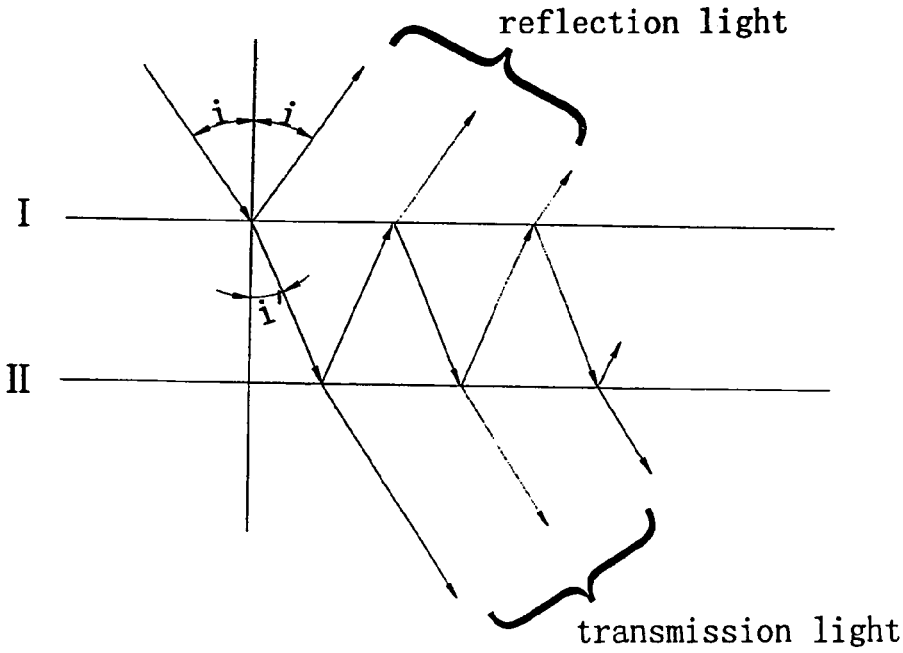
FIG. 2 shows reflection of light, refraction of light and transmission of light for a glass plate.

With reference to the drawings there is shown in FIGS. 1-8 a capped xenon metal halide discharge lamp for vehicles according to the present invention which includes an arc tube (1) with two neck shaped portions (2*a*, 2*b*). The two neck shaped portions are gas tight sealed to two electrode connectors (4*a*, 4*b*). The two neck shaped portions are surrounded by an outer gas tight tubular envelope (5) which has a ball shaped portion (5*a*), which just surrounds the ball shaped arc tube (1). The first end of envelope (5) is fixed on a cap (15). A nickel wire (7) is connected through bridge (8) or is directly connected to current conductor (4*b*) of the second electrode (3*b*). Wire (7) runs along the outside of the lamp to connect the second current supply conductor (14). The end of second neck shape portion of arc tube (2*c*) is expanded to form a bell shape. The edge of the bell (2*c*) nearly touches the outer envelope (5) and the envelope (5) and the edge of the bell (2*c*) are flame sealed to form a gas tight seal.

There is a cylinder shaped depression (16) at the surface of the center of cap (15). Three or more (preferably four) stainless steel poles (11) project from the cap surface surrounding the depression (16). The first end of the envelope is inserted into the depression (16). A ring shaped hoop (10) having one or two or four sections, are formed tightly around the lower part of outer envelope (5). Four poles (11) are inserted in four holes (10*a* 10*b*) on the wings of the ring shaped hoop (10) respectively and are connected by point welding.

The theory of geometric optics shows that when a light beam is projected onto a glass plate with incidence angle i (FIG. 2), a part of the beam of light will be reflected at the interface designated by the letter I between the air and the glass plate with reflection angle i which is the same as the incidence angle. Another part of the light beam going into glass plate will be refracted by the glass with an angle i' in accordance with:

$$n_1 \sin i = n_2 \sin i'$$

where $n_1$ and $n_2$ are the refraction index of air and glass, respectively.

The refracted light beam will be divided to two parts at the interface of glass and air designated by the letter II. The first part will go out through the glass plate and become transmitted or transmission light, another part of refracted beam will be reflected light and will exit the glass plate and become transmission light, another part of it will be reflected again by the interface. A part of the reflected light will continue to reflect between two interfaces I and II time after time. Each time, a part of the reflected light beam will exit through the interface and become transmission light.

Figure 4:
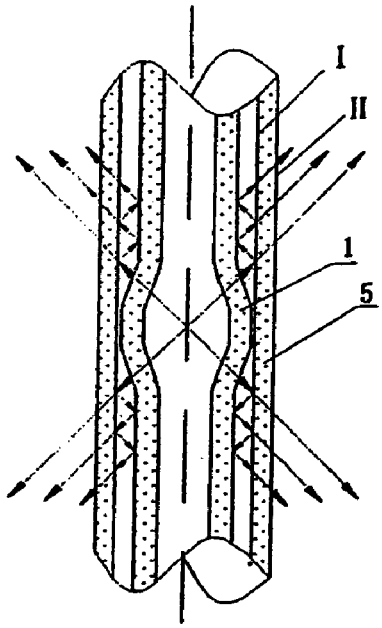
Fig.4 PRIOR ART
FIG. 4 shows the light beam trace from the tubular envelope of a normal conventional lamp.
Figure 5:
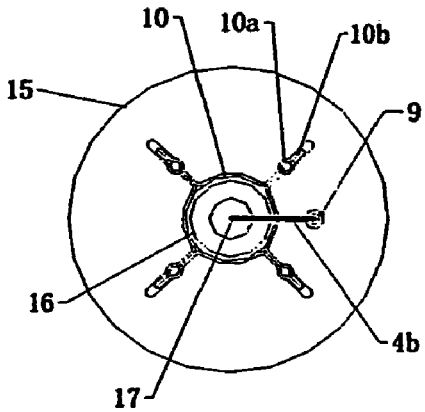
FIG. 5 shows a variation of FIG. 1 in side elevation a plan view of the lamp of FIG. 1.
Figure 6:
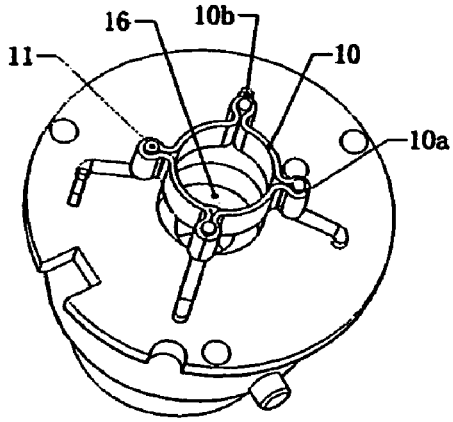
FIG. 6 shows the drawing a perspective view of the cap with a ring shaped hoop that for fixing the lamp.

From the simple geometric optical theory of reflection, refraction and transmission, we see that, for the conventional xenon metal halide lamp with the tubular outer envelope as shown in FIG. 4, the light emitted from the arc tube will be reflected partially by inside surface I of the outer envelope (FIG. 4). Another part of the light passing through interface I will enter the envelope glass and will be refracted by the envelope glass material, then will be partially transmitted and partially reflected until the light beam arrives at the outer interface II of the envelope and the air. This process will continue in the space between interface I and II, and in the space between the arc tube and envelope and also between the outer surface and inside surface of arc tube. Therefore, the light emitted from the arc is separated, a part of it is directly emitted out as a transmission beam, and another part diverges toward the two ends of the halide lamp and decays along the lamp axis, (see FIG. 4) because of reflections and refractions.

Figure 3:
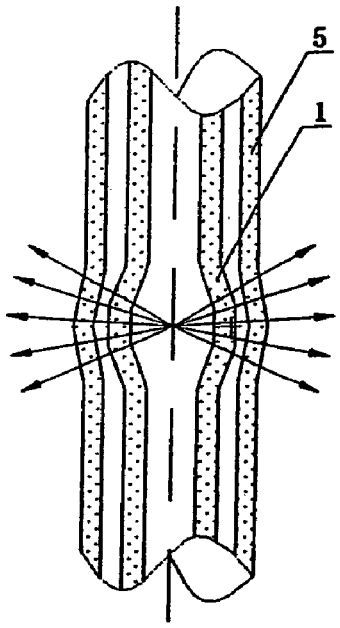
FIG. 3 shows the light beam trace from the ball shaped envelope of a lamp according to the invention.
Figure 7:
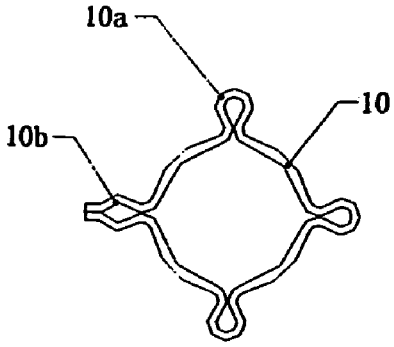
FIG. 7 shows a ring shaped hoop with four wing holes formed by a single metal ribbon.
Figure 8:
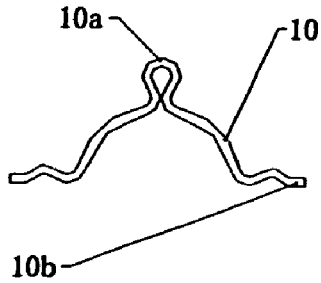
FIG. 8 shows half of the ring shaped hoop.
Figure 9:
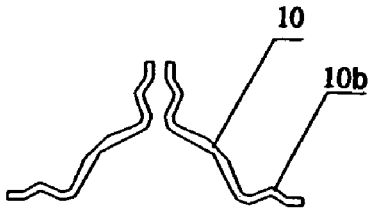
FIG. 9 shows a ring shaped hoop constructed using four sections.
Figure 10:
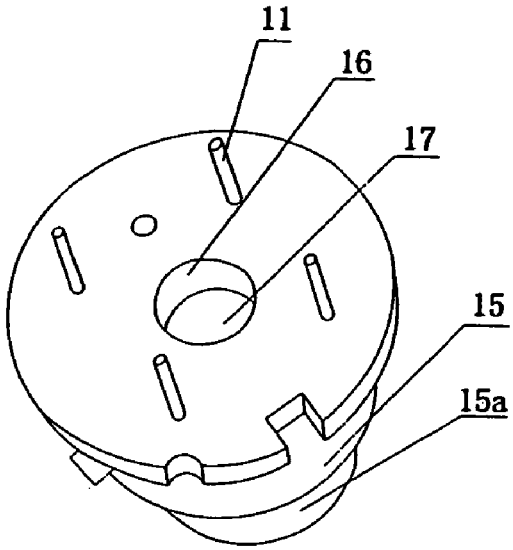
FIG. 10 shows the cap of the lamp with four implanted poles.

All of the divergence light is the source of glare. This is the reason why drivers always think that the serious glare is always caused by xenon metal halide lamps. This problem present in conventional lamps has been in large part been solved by the present invention The main points of this invention are summarized as follows:

3. The outer envelope of arc tube is generally tubularly shaped but with a ball shaped section in the middle of envelope surrounding the ball shaped arc tube. The wall of the ball shaped envelope is parallel with the wall of the arc tube. Therefore, the light from arc tube will directly emit out through the arc tube and the ball shaped envelope with a very small reflection because the direction of radiation is almost perpendicular to both of the two walls (as is shown in FIG. 3). As a result, compared with the straight tubular shaped envelope (FIG. 4) the beam efficiency of the lamp according to the present invention is increased and the glare is reduced as is shown in FIG. 3. Furthermore, the ball shaped envelope causes a more uniform temperature distribution on the lamp. Therefore all parameters of the lamp according to the present invention are improved including: higher luminous efficiency, better rendering index, higher reliability and longer life.
4. The sealing of the end far from the cap of the lamp of the present invention is different than in the conventional lamp. The far end of the envelope of the conventional lamp is heated by flame to the temperature at which the quartz is melted and shrinks together with the neck portion of the arc tube to obtain gas tight sealing. In the lamp according to the present invention the arc tube at the far end of envelope does not shrink but is enlarged, resulting in a bell shaped mouth portion before sealing. The diameter of bell mouth edge is near but smaller than the inner diameter of the outer envelope. The bell mouth edge is moved close to the outer envelope and is heated by a special burner until the bell mouth edge and the outer envelope are melted together for gastight sealing. This sealing structure is simpler and results in reduced less glare emission from the end which just acts like a window for light emission and it also shortens the length of lamp, resulting in improved vibration ruggedness.
3. The third main point of this invention is the attachment of the lamp to the cap. In this invention a few (three or more) stainless steel poles are implanted in the cap surface and project from the cap around the lamp which is mounted in the central depression (16) of the cap. A metal ring shape hoop (10) is constructed of one or two or four sections as shown in FIG. 7 FIG. 8 and FIG. 9. The hoop fits tightly around the lower part of lamp. The four poles on the cap are inserted in four wing holes of the hoop respectively and connected by point welding. This results in an improvement in simplicity, cost and ruggedness.

We claim:

1. A capped xenon metal halide discharge lamp for vehicles comprising:

an arc tube, with said arc tube having walls, a gas tight outer envelope, with said outer envelope having walls, with said outer envelope disposed surrounding said arc tube, wherein said arc tube is made of pure quartz glass and filled with high pressure xenon, a Mercury (Hg) and metal halide pellet disposed in said arc tube, wherein said outer envelop is made of glass which prevents transmission of ultra violet (UV) light, wherein said arc tube and said outer envelope define a space therebetween, wherein said space is exhausted to form a vacuum, wherein said outer envelope comprises:

a portion of said outer envelope disposed proximate to said arc tube and wherein said walls of said arc tube and said walls of said outer envelope are generally parallel, wherein said capped xenon metal halide discharge lamp further comprises:

a cap, with said lamp attached to said cap, a plurality of poles formed on said cap, and a hoop having a plurality of holes with said holes matching said plurality of poles formed on said cap.

2. The capped xenon metal halide discharge lamp for vehicles as claimed in claim 1, wherein said hoop comprises two portions.

3. The capped xenon metal halide discharge lamp for vehicles as claimed in claim 1, wherein said hoop comprises four portions.

4. The capped xenon metal halide discharge lamp for vehicles as claimed in claim 1, wherein said cap comprises a central portion having a depressed area with said arc lamp projecting into said depressed area.

* * * * *